US007997970B2

(12) United States Patent
Katz et al.

(10) Patent No.: US 7,997,970 B2
(45) Date of Patent: Aug. 16, 2011

(54) INTERACTIVE THREE DIMENSIONAL GAMING DEVICE WITH RECESSED CHAMBERS

(75) Inventors: Ryan Katz, Oak Park, IL (US); Steven Rehkemper, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 1005 days.

(21) Appl. No.: 11/855,635

(22) Filed: Sep. 14, 2007

(65) Prior Publication Data

US 2008/0070657 A1 Mar. 20, 2008

Related U.S. Application Data

(60) Provisional application No. 60/825,969, filed on Sep. 18, 2006.

(51) Int. Cl.
*A63F 9/24* (2006.01)

(52) U.S. Cl. ..... 463/9

(58) Field of Classification Search ..... 463/9
See application file for complete search history.

(56) References Cited

U.S. PATENT DOCUMENTS 4,207,087 A 6/1980 Morrison et al.
5,417,425 A 5/1995 Blumberg
5,573,245 A 11/1996 Weiner
6,116,598 A * 9/2000 Maythenyi ..... 273/148 R
6,186,504 B1 2/2001 Maxim

FOREIGN PATENT DOCUMENTS

JP 2006-192194 7/2006

OTHER PUBLICATIONS

English Translation of Japanese Patent Publication 2006-192194 obtained from the JPO's automatic on-line translation services.

* cited by examiner

*Primary Examiner* — Pierre E Elisca
(74) *Attorney, Agent, or Firm* — Adam Sacharoff; Much Shelist

(57) ABSTRACT

A puzzle or gaming device is provided with a polyhedron housing having a plurality of substantially planar faces, each face includes a plurality of tiles and at least one opening. A plurality of response units are secured separately about each opening such that a top edge defined by the response unit is positioned in the openings and substantially flushed with a surface of the tiles adjacent the opening thereby maintaining a substantially planer face. A processor is provided and includes a pre-programmed gaming content stored on a memory. The process is in communication with light sources and switches, such that the pre-programmed gaming content when activated by the processor randomly activates or deactivates light sources promptly a user to respond by maneuvering the polyhedron housing such that the line of sight of a light source changes wherein the user is able to respond to the pre-programmed gaming content by pressing one or more switches.

19 Claims, 7 Drawing Sheets

10

INTERACTIVE THREE DIMENSIONAL GAMING DEVICE WITH RECESSED CHAMBERS

CROSS REFERENCE TO RELATED APPLICATIONS

The application claims priority to U.S. Provisional Application Ser. 60/825,969 entitled "Interactive Three Dimensional Gaming Device with Recessed Chambers" filed on Sep. 18, 2006.

FIELD OF THE INVENTION

The present invention relates to an interactive gaming device, and in particular to a three-dimensionally shaped device where a user manipulates and maneuvers the device to press a plurality of illuminated buttons in accordance to gaming content.

BACKGROUND OF THE INVENTION

Three dimensional gaming devices and puzzles are well known in the industry. Such devices include both mechanical and electronic attributes. Typically, a user is required to solve a problem or reach an objective by manipulating or responding to the device. The Rubik's Cube is a well-known mechanical version utilizing physical manipulation of the device while "SIMON" is a well-known electronic version that combines lights and sound to enhance a user's gaming experience. While these gaming devices are well known, there is always a continuing need for improvements or changes in the gaming experience.

SUMMARY OF THE INVENTION

In one embodiment of the present invention, there is provided an interactive gaming device that includes a polyhedron housing having an internal mount plate. The polyhedron housing defines a plurality of faces, wherein each face of said plurality of faces includes a plurality of tiles and an opening to accommodate a response unit. Each response unit is secured to the internal mount plate in the openings such that a top edge defined by the response unit is substantially flushed with tiles adjacent the opening. Each response unit is further defined as a recessed chamber having a base with a button that is in communication with a switch. The recessed chamber further being sized to accommodate a portion of a user's finger, and having a predetermined depth such that the line of sight of the button is impaired when viewed at an angle. A processor is mounted to the internal mount plate and is in communication with each switch. The processor stores pre-programmed gaming content on a memory.

In another embodiment of the invention the interactive gaming device may include a light driver in communication with the processor and one or more of the light sources to control a level of illumination of the light sources. The processor is directed by the pre-programmed gaming content to control the level of illumination such that a user must respond to a decrease in the level of illumination of a light source to trigger the switch corresponding to the decreased illuminated light source. Once triggered the processor will control the light driver to increase the level of illumination back to a starting setting. If the user is not capable of triggering the switch corresponding to the decreased light source before it reaches a lower level, such as a light off state, the processor may time-out the game.

In this embodiment the interactive gaming device may further comprises a light in each recessed chamber that is controlled by the processor.

In another embodiment the polyhedron housing includes six response units, each response unit being positioned such that each of the recessed buttons point in a different direction. In another embodiment the polyhedron housing is cube-shaped.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
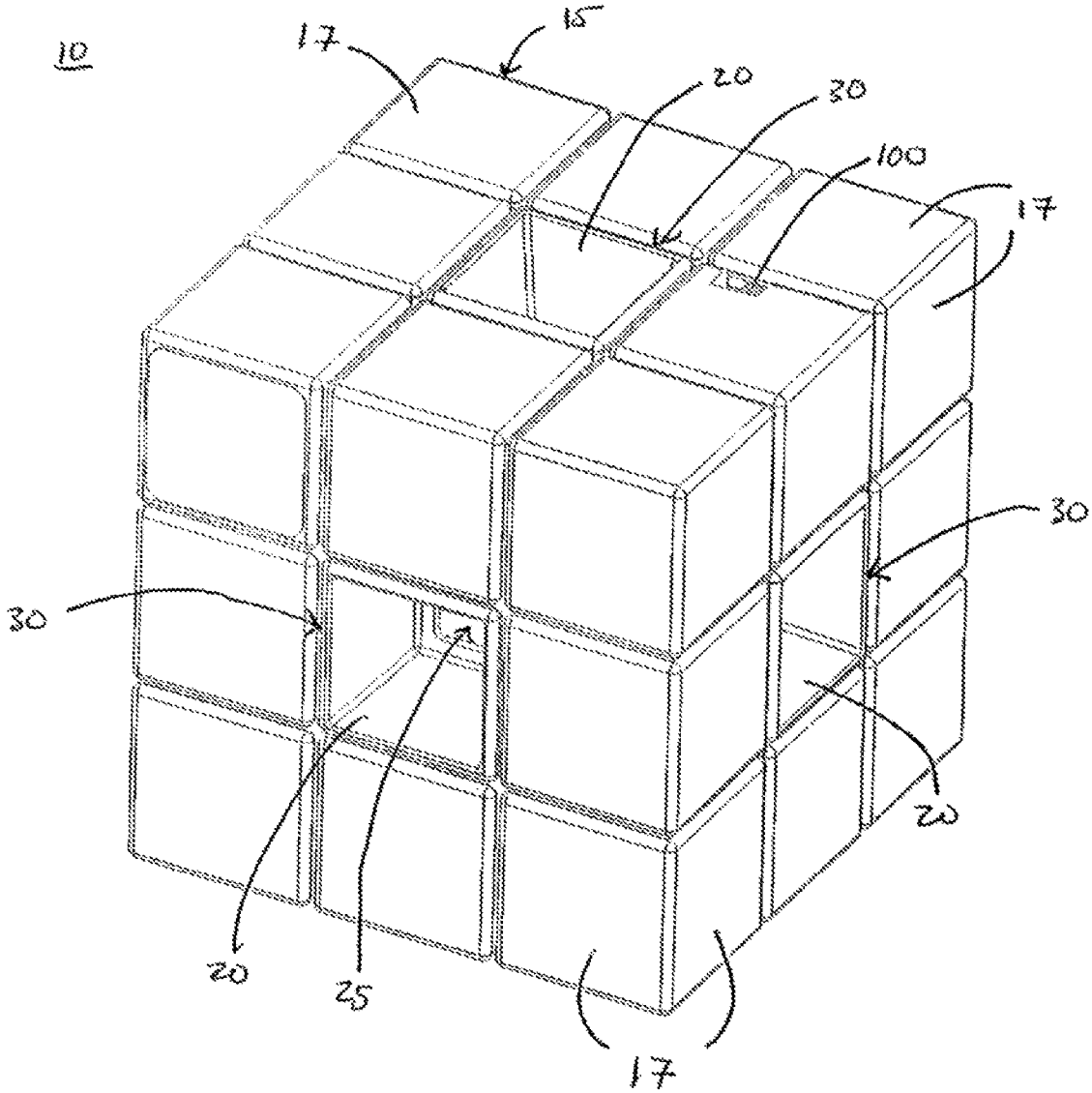
FIG. 1 is an illustrative view of the interactive gaming device.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention and/or the claims and embodiments illustrated.

Referring now to FIG. 1, in accordance to a first embodiment, there is illustrated an interactive gaming device 10 that includes an external housing 15 and a plurality of response units 30 that further include a plurality of button mechanisms 25. The button mechanisms 25 are preferably made up of a light emitting diode (LED), a lens and a switch positioned at the base of the response units 30. These LEDs may have any number of different colors, or, as in the first embodiment, include a white LED with a colored lens.

The external housing 15 may take on several different three-dimensional geometric shapes, such as a cube, sphere, or pyramid. Virtually any three-dimensional shape may be used. An aspect of the external housing 15 is that the faces defined by the three-dimensional shape each include a plurality of tiles 17 that may surround the response units 30.

Figure 2:
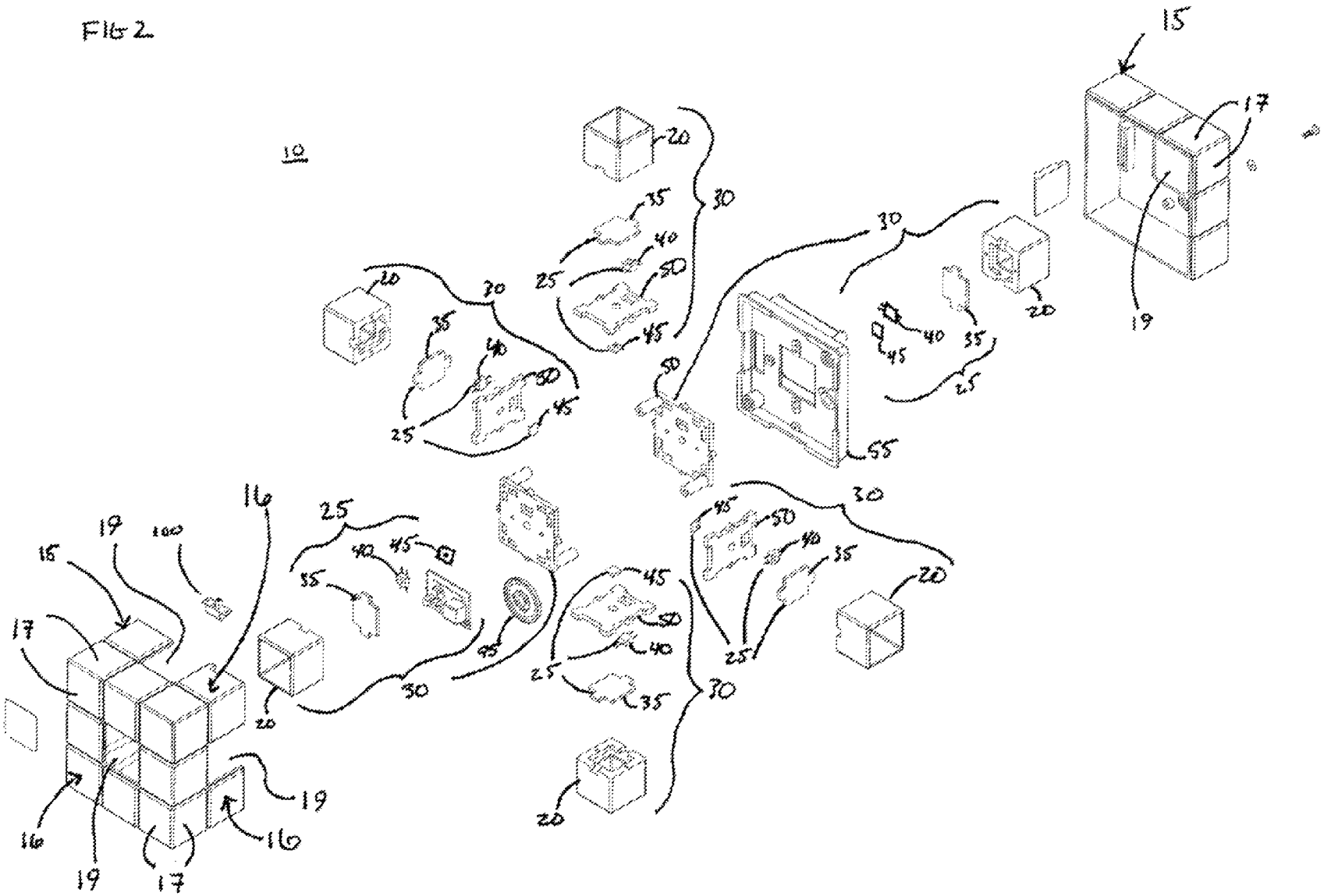
FIG. 2 is an exploded view of the components of the interactive gaming device.
Figure 3B:
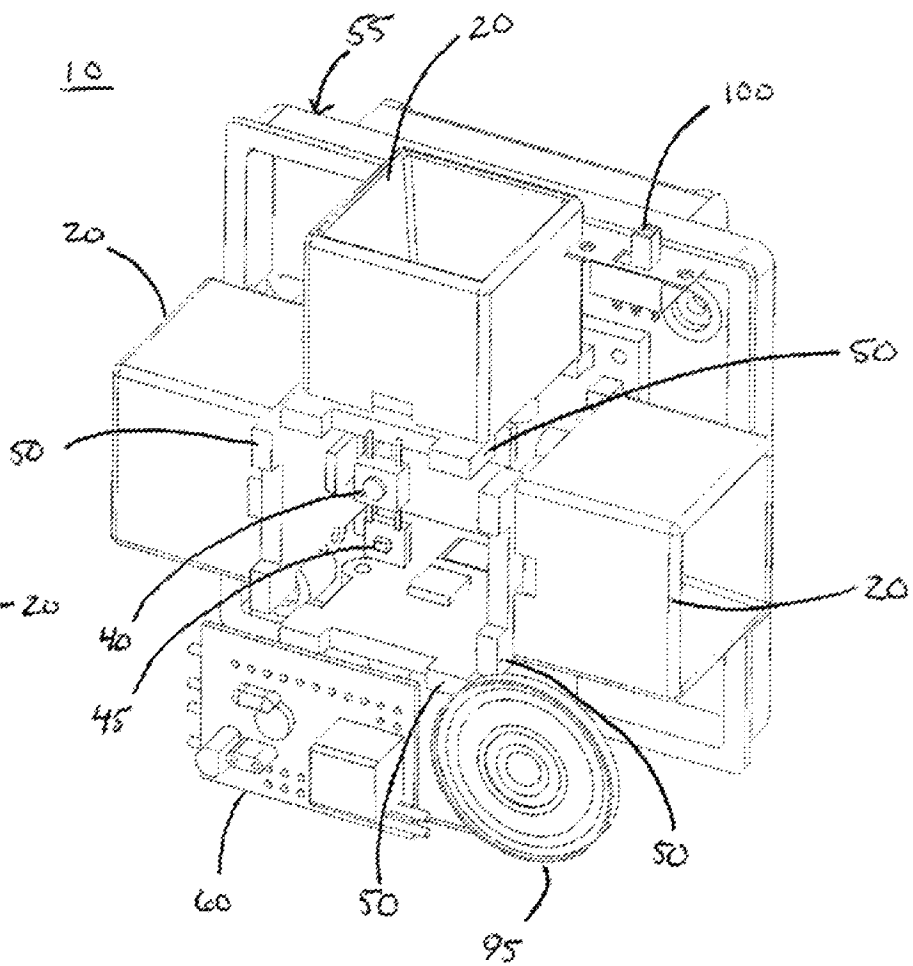
FIG. 3*b* is an illustrative view of the internal components of the interactive gaming device.
Figure 3A:
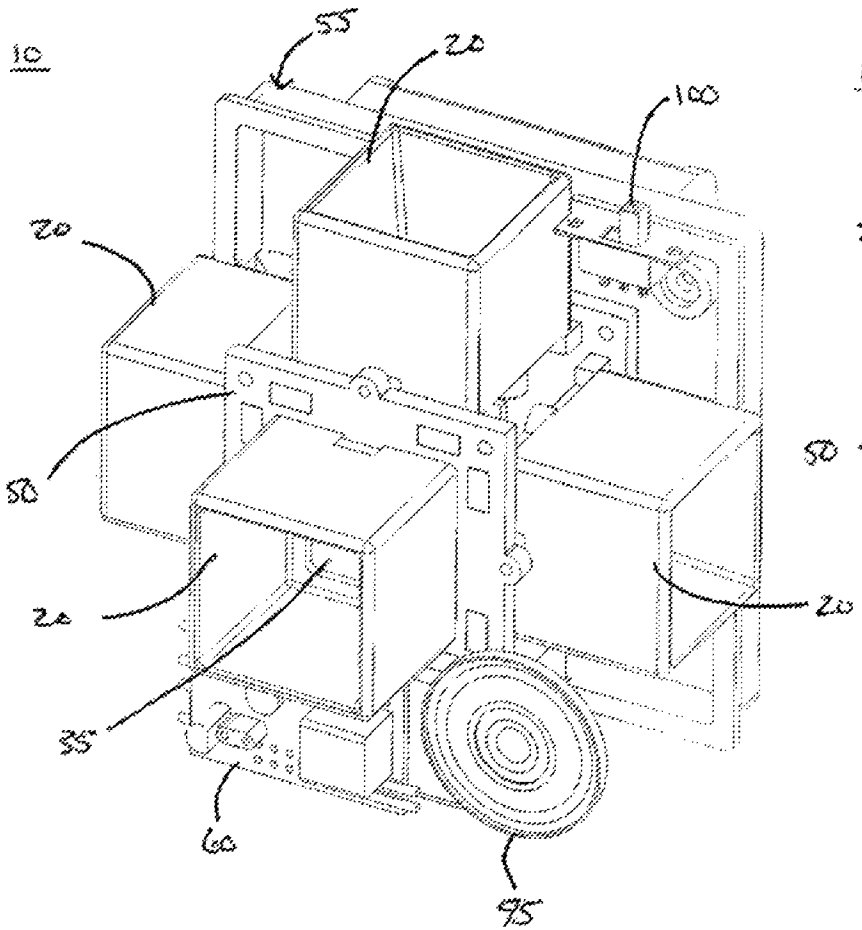
FIG. 3*a* is an illustrative view of the internal components of the interactive gaming device.
Figure 3J:
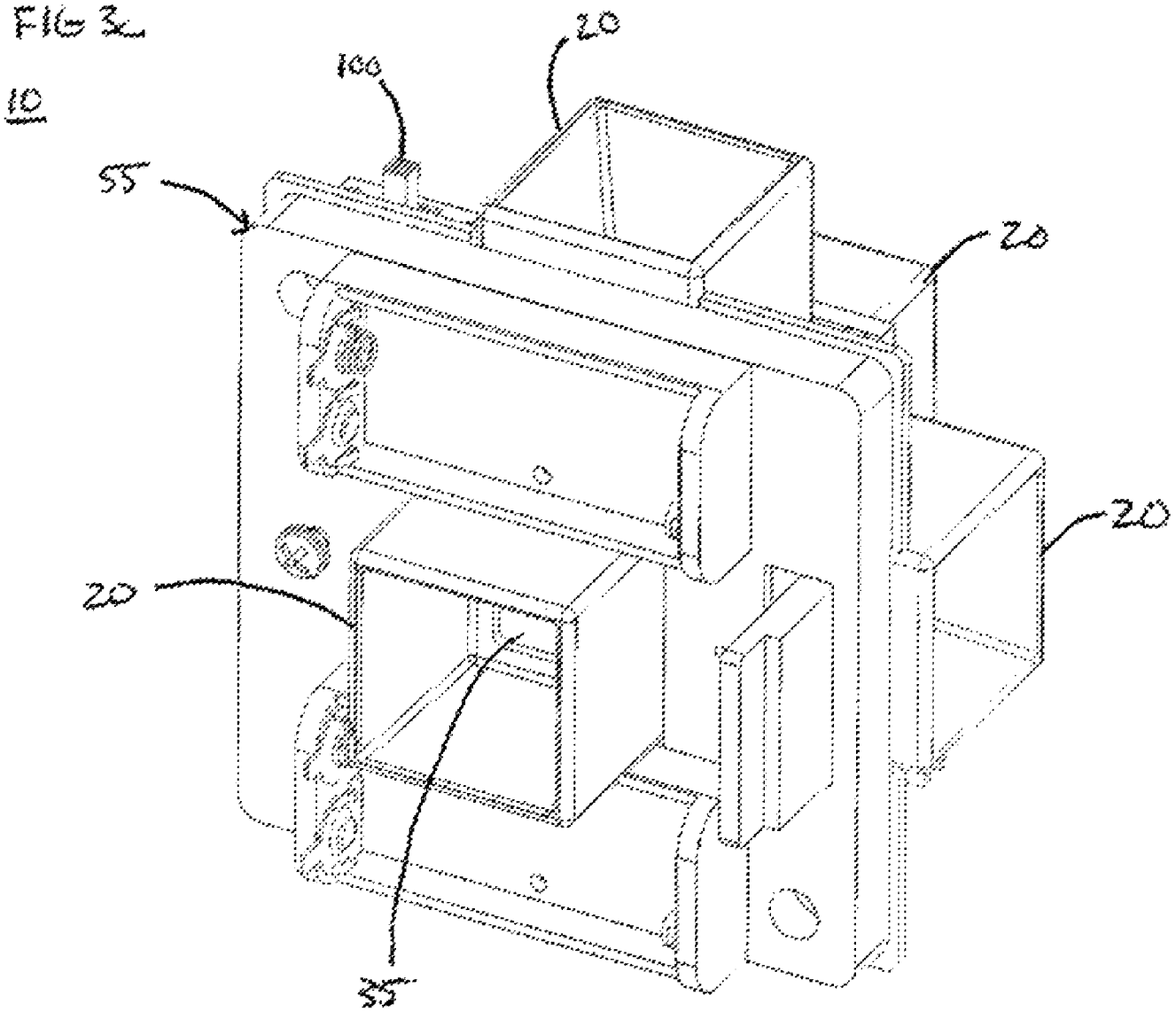
FIG. 3*c* is an illustrative view of the internal components of the interactive gaming device.
FIG. 3*d* is an illustrative view of the internal components of the interactive gaming device.
Figure 3D:
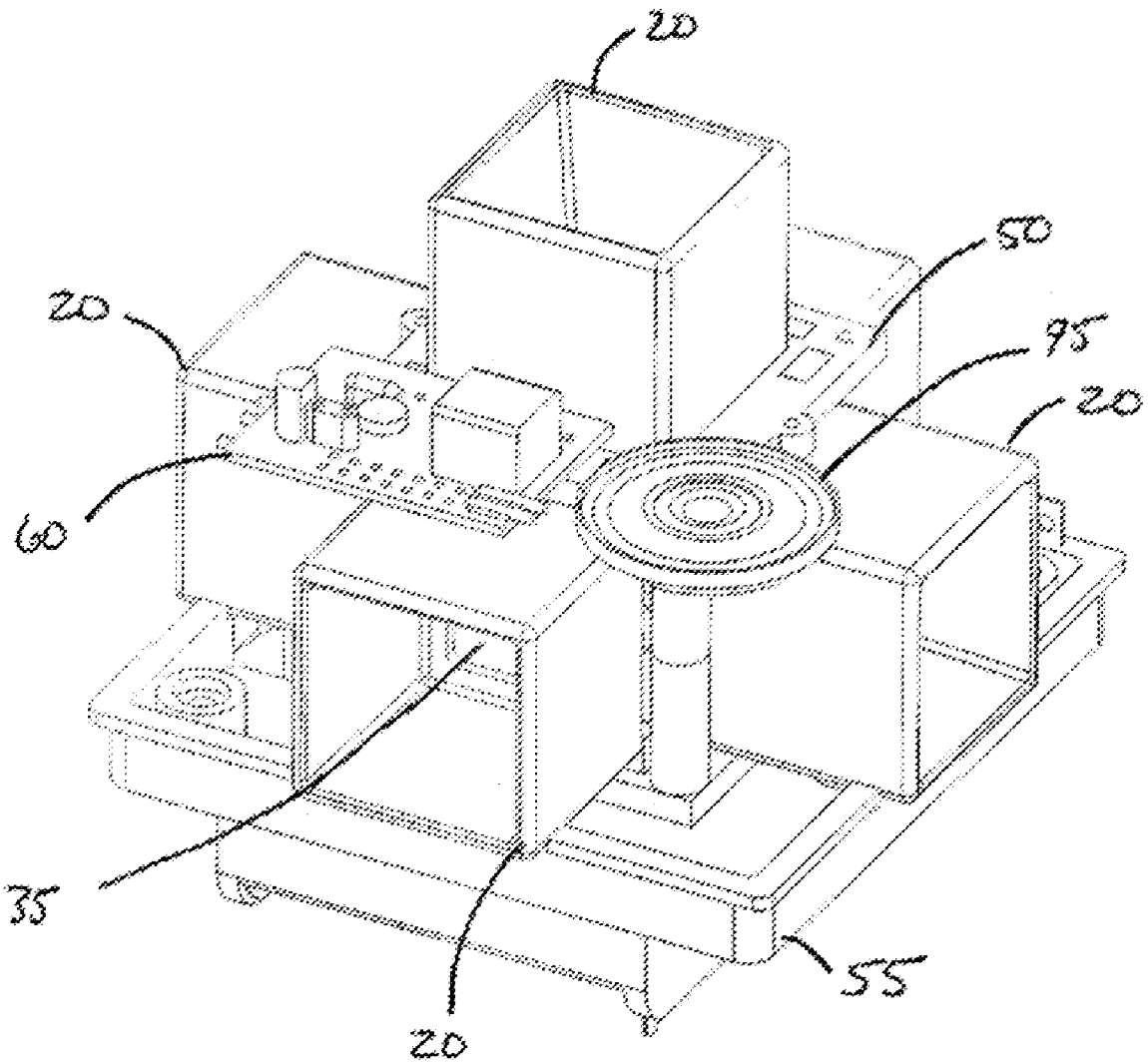

Referring now to FIG. 2, the exploded view of FIG. 1 is shown. As illustrated, the housing 15, which may also be viewed as a polyhedron housing, has a number of external faces 16. Each face includes the plurality of tiles 17 and includes one or more openings 19 that are surrounded by two or more tiles depending upon its location. By placing the opening 19 in between tiles 17, the location of the button mechanism that needs to be pressed during game play is not visible from all lines of sight and increases the challenging aspects of the game.

Referring also to FIGS. 3*a*-3*d*, distributed throughout each opening 19 is the response unit 30. In one embodiment, each response unit 30 includes a recessed chamber 20 and a button mechanism 25. The button mechanism includes a lens 35, a switch 40, and an LED 45. The switch 40 and the LED 45 may be mounted to a switch plate 50. The response units 30 are further mounted to a mount plate 55 positioned within the housing 15. The response unites 30 are separately positioned in the openings 19 such that an edge 21 of the recessed chamber 20 is substantially flush with a surface plane of the surrounding tiles 17. Thus, when the button mechanisms 25 are positioned at the base of the recessed chambers, the button mechanisms 25 and the LEDs 45 are not visible from all lines of sight, which increases the level of difficulty of the game.

The button mechanisms 25, which are located at the base of the recessed chambers 20, are in communication with an integrated circuit (IC) 60 (described below) by an electrical connection that permits the transfer of power and information. The lens 35 would be positioned at the base of the recessed chamber 20 above the switch and LED, such that when the lens 35 is pressed by a user, the switch 40 is triggered.

The processor (described below) accesses game content (such as preprogrammed signals or audio content) stored on a memory internal or external to the IC 60. Further, the IC 60, amplifier (described below), switches 40 and LED drivers (described below) are in communication with a power source such as a battery pack.

In the first embodiment, the interactive gaming device 10 includes a means to trigger game play and responses. An example of the triggered game play and responses is included in a "play pattern" example and game play examples below.

Further, in accordance to the first embodiment, to play with the gaming device a user manually rotates and maneuvers the interactive gaming device to locate button mechanisms 25, which appear illuminated by activated LEDs 45 in accordance to gaming content. The gaming content is considered interactive or evolving with a play pattern designed in the programming. The gaming content may include audio information and/or data or LED activation. The audio information may be generated or converted into any type of signal or format needed for playing or transferring the gaming content, such as but not limited to digital, analog, wav, etc. As such, when a switch is triggered, the interactive gaming device responds based on the programming contained within the gaming content enabling a user to interact with the interactive gaming device in a variety of different capacities.

Figure 4:
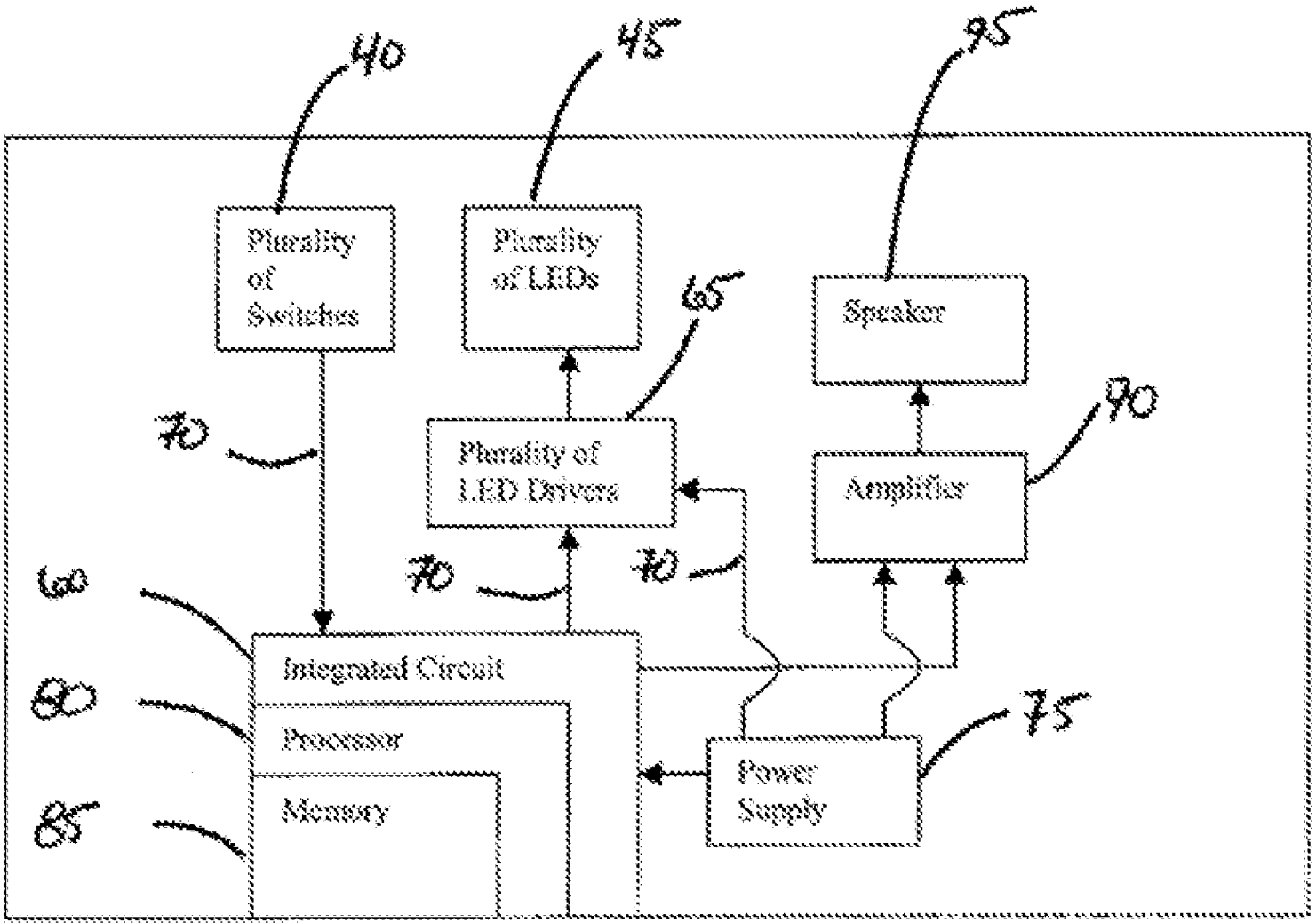
FIG. 4 is a block diagram of the interactive gaming device for the first embodiment.

Referring now to FIG. 4, there is shown a block diagram provided for an embodiment of the interactive gaming device 10. The IC 60 communicates with a plurality of LED drivers 65 via an electrical connection 70. Utilizing the electrical connection 70, data (such as preprogrammed audio content, preprogrammed responses and/or randomly generated signals, etc.) can travel between the IC 60 and the plurality of LED drivers 65. The plurality of LED drivers 65 also receives an appropriate amount of power from the power source via an electrical connection 70. Utilizing control signals (such as randomly generated or preprogrammed) the IC 60 then directs the LED driver 65 to transfer the appropriate amount of power to the plurality of LEDs 45 to activate a desired state. Examples of a desired state include a "light on," a "light off," or a varying level of illumination for an LED 45. The power is obtained from a power source 75 while the data is obtained from a processor(s) 80. The processor(s) 80 is designed to run the program(s) stored on a memory 85.

When one of the plurality of switches 40 is triggered in response to a user's input, a signal is sent via an electrical connection 70 to the IC 60. The IC 60 contains the processor(s) 80 and may include a memory 85. The IC 60 receives signals from the plurality of switches 40. The IC 60 further includes programming and electronic components to facilitate and direct audio content, control signals, and data within the interactive gaming device 10. The IC 60 is also in communication with the power source 75 and an amplifier 90. The memory 85 contains gaming content. The processor(s) 80 in the IC 60 accesses the gaming content based on a program and/or in accordance to the generated control signals received from the plurality of switches 40. The processor(s) 80 then generates a response that includes signals and may be in the form of audio or control signals. While the interactive gaming device 10 is preprogrammed to respond, the selection of the type of response may be randomly selected. From the processor(s) 80, audio signals are transferred to the speaker 95 while control signals are transferred to the plurality of LED drivers 65 via an electrical connection 70. The LED drivers 65 then direct the plurality of LEDs 45 to change to a desired state, based on a program and/or in accordance to a user's input or preprogrammed response.

Figure 5A:
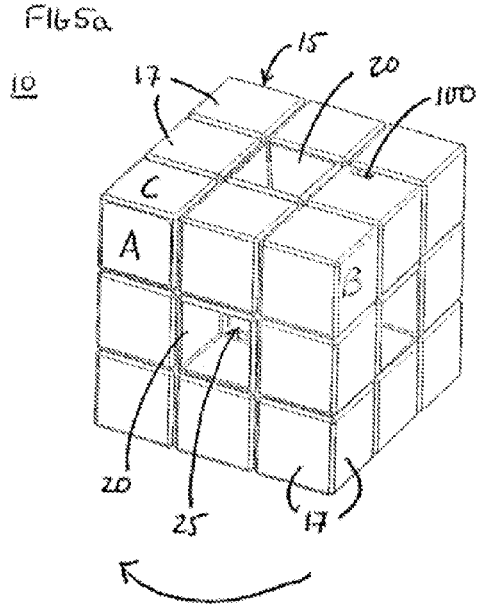
FIG. 5*a* is step one of an example of a play pattern for the first embodiment of the interactive gaming device.
Figure 5B:
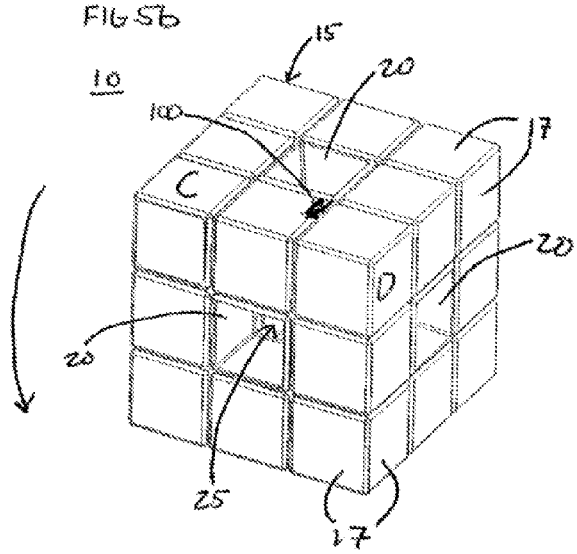
FIG. 5*b* is step two of an example of a play pattern for the first embodiment of the interactive gaming device.
Figure 5C:
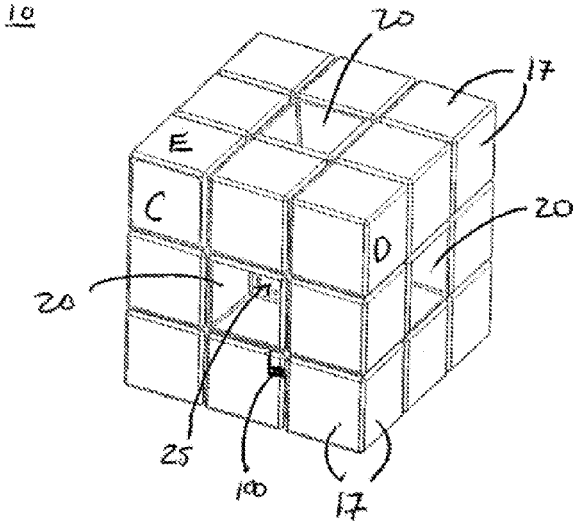
FIG. 5*c* is step three of an example of a play pattern for the first embodiment of the interactive gaming device.

One illustrative example can be described in the following "play pattern" as show in FIGS. 5*a*-5*c*. Power switch 100 is turned on to activate the interactive gaming device 10. Once a game is selected, the processor 80 begins to change one or more of the plurality of LEDs 45 to a "light on" state, prompting the user to press one or more of the corresponding button mechanisms 25 illuminated by a the lit LED 45. Activating or trigging one of the switches 40 sends a signal to the processor 80. The processor 80 then accesses the gaming content to retrieve audio data to transfer to the speaker 95 and signals to control the state of the LEDs 45. For example and as illustrated in 5*a*, an LED 45 on the C-side will receive a control signal from the IC 60, directing the LED 45 on the C-side to change to the "light on" state, thus illuminating the button mechanism 25. When a user is looking at the interactive gaming device 10 from the A-side, they will not be able to see the button mechanism 25 illuminated on the C-side. A rotation of the interactive gaming device 10 in the direction of the arrow in 5*a* will also not place the LED 45 on the C-side in view as illustrated in 5*b*. However, another rotation of the interactive gaming device 10 in the direction of the arrow in 5*b* will take the user to the view in 5*c*. At this point, the user will be able to see the button mechanism 25 illuminated on the C-side. The user then presses the corresponding button mechanism 25 on the C-side, sending a response signal to the IC 60. The IC 60 receives this response signal and changes the state of a different, or the same LED 45. Since the LEDs 45 may be positioned at the bottom of the recessed chambers 20, a user must manually rotate and maneuver the interactive gaming device 10 to permit a user's line of sight to view the LED 45 in the "light on" position. This creates a challenging interactive element because the LEDs 45 are not at the surface of the external housing 15, where they are easily visible and do not require additional user rotation of the external housing 15. The IC 60 will continue to receive input signals from the switches 40, and direct output signals to the speaker 95 and the LEDs 45. The resulting play pattern will direct a user to continuously rotate and manipulate the interactive gaming device to follow the IC's 60 direction, preferably with a time pattern variation to increase the difficulty of play as a user progresses through the play pattern.

Numerous games may be played with the interactive gaming device 10. These games are selected by a user pressing the appropriate button mechanisms 25. Several games are described below, however, the IC (described below) may be programmed to play any number of games.

First Example of Game Play

In a first example of game play, the object of the game is for a user to fully illuminate all of the LEDs 45 by pressing the button mechanisms 25 as the light begins to fade out. At the start of game play, each of the six LEDs 45 are in a lights out state. The processor 80 accesses the gaming content to retrieve audio data to transfer to the speaker 95 to emit a sound notifying a user of the start of game play. The processor 80 sends control signals to one or more of the LED drivers 65 which direct the corresponding LED 45 to illuminate. The processor 80 then directs the LED driver 65 to gradually decrease the level of illumination (essentially, a fade out). The user then presses the illuminated button mechanism 25 which appears to fade to increase the level of illumination back to the maximum level. The corresponding switch sends a control signal to the processor 80. The processor 80 sends audio data to the speaker 95 to emit a corresponding audio sound.

As the user presses the first button mechanisms 25 to illuminate, the other LEDs 45 subsequently switch to the light on position and begin to fade as described above. If an LED 45 fades to the light out state, game play ends. If the user is able to get all six LEDs 45 to their full light on state, game play ends. The processor 80 may be programmed to generate a "game over" or "winner" audio signal when the user reaches either scenario. Also, the processor 80 may be programmed to increase the speed of the fading effect to make the game play more challenging. Further, the processor 80 may be programmed to time out or end game play after a predetermined length of time has expired. After the conclusion of game play, the user has the option to start a new game by pressing the corresponding button mechanisms 25 or selecting one of the other games included in the interactive gaming device.

Second Example of Game Play

In a second example of game play, the object is to press a button mechanism 25 illuminated by an LED 45 in the light on state before the LED 45 switches to a light out phase. The processor 80 may be programmed to flash the LEDs 45 between a light on or light out phase, prompting a user to respond in accordance to the game play.

The processor 80 includes programming to provide multiple levels of game play, preferably increasing in the difficulty of play as a user advances in the game play. The processor 80 is programmed to time out game play after a predetermined length of time has elapsed for each level of game play.

For example, when the first LED 45 is switched to the light on state, a timer begins a countdown scheduled to last thirty seconds during which time the user needs to press as many button mechanisms 25 illuminated by the LEDs 45 as possible before the programming directs the LED 45 to switch to the light off position in accordance with game play. Once the countdown time is reached, the processor 80 determines a performance rating of the user, such as a percentage of button mechanisms 25 correctly pressed versus corresponding LEDs 45 lit. If the user achieves the required percentage of hits, the user advances to the next level. As the user advances in levels, the speed in which the LEDs 45 flash between the light on state and light off state increases. The programming may also include audio commands to emit through the speaker 95, signaling completion of a level and the advance to the next level.

Third Example of Game Play

In a third example of game play involving multiple users, the object of the game is similar to the game known as "hot potato." At the start of game play, the processor 80 directs an audio command to emit from the speaker 95, requesting one of the users to input the desired number of players. A user responds by pressing a button mechanism 25 corresponding to the number of players.

An LED 45 switches to the light on phase to signal the start of play. Simultaneously, the processor 80 tracks time while directing audio signals to emit from the speaker 95, such as a simulated clock ticking sound. Since the button mechanisms 25 are at the base of the recessed chambers 20, players do not have a direct line of sight to the button mechanism 25 now illuminated. The first player maneuvers the interactive gaming device 10 to locate the corresponding illuminated button mechanism 25 and presses the button mechanism 25 before passing the interactive gaming device 10 to the next user. Pressing the illuminated button mechanism 25 with an LED 45 in the light on state triggers the associated switch 40 and sends a signal to the processor 80. The processor 80 responds by randomly triggering another LED 45 to switch to the light on state. The next user then maneuvers the interactive gaming device 10 to locate the next illuminated button mechanism 25.

Upon locating and pressing the illuminated button mechanisms 25, the user passes the interactive gaming device 10 as above, prompting the processor 80 as above. These steps are repeated as the interactive gaming device 10 is passed to subsequent players until the processor 80 determines that the time of play has expired. Scoring may be recorded according to gaming content, or a user may simply be eliminated. This interaction and game play may continue until a winner is determined.

Fourth Example of Game Play

In a fourth example of game play, the object of the games is to determine a randomly generated LED 45 illumination sequence to fully illuminate all the LEDs 45 by pressing the corresponding button mechanisms 25 with the fewest number of attempts. At the start of game play, all of the LEDs 45 are in the lights off state. The processor 80 directs an audio signal to the speaker 95 to emit an audio sound to notify the users to start play.

A user presses one of the button mechanisms 25 in an attempt to find the first correct button mechanism 25 in the randomly generated sequence. Once the button mechanism 25 is pressed by the user, a signal is sent to the processor 80. The processor 80 determines if it is the correct signal (corresponding to the button mechanisms 25) according to the randomly generated sequence. If the button mechanism 25 selected is not the first in the sequence, no LEDs 45 will switch to the light on state and the processor will send an audio signal to the speaker 95 to notify the user that the selection was incorrect. If the button mechanism 25 selected is the first button mechanism 25 in the sequence, the processor 80 will direct the corresponding LED 45 to illuminate and send an audio signal to the speaker 95 to notify the user that the selection is correct.

The user then selects another button mechanism 25 in an attempt to find the subsequent button mechanism 25 in the sequence. If the second button mechanism 25 selected is incorrect, the processor 80 sends an audio signal to the speaker 95 to notify the user that the selection was incorrect. Simultaneously, the processor 80 will reset the game play to the initial button mechanism 25 in the sequence. Game play proceeds accordingly until the user selects all six button mechanism 25 according to the randomly generated sequence.

Once the user is able to press the button mechanisms 25 in the correct sequence, the LEDs 45 will all be in the light on state and the processor 80 will send an audio signal to the speaker 95 indicating completion of the game play. Further, the processor 80 may record the correct and incorrect presses to provide an accuracy and timing rating.

Fifth Example of Game Play

In a fifth example of game play, the object is to locate LEDs 45 subsequently switched to the light on state and press the corresponding button mechanisms 25 before a predetermined time expires. The LEDs 45 may be subsequently switched to the light on state in a randomly generated sequence.

To start game play, the processor 80 sends a signal to one of the LEDs 45 to switch to the light on state. The user maneuvers the interactive gaming device 10 to locate the corresponding button mechanism 25. Since the button mechanism 25 and LEDs 45 in this embodiment are located at the base of the recessed chambers 20, a user will typically not have a direct line of sight to the button mechanism 25 when illuminated by the LEDs 45, creating a challenging scenario requiring a user to maneuver the interactive gaming device 10 quickly to locate the illuminated button mechanism 25 before time expires.

Game play continues while the user continues to locate and press the correct button mechanism 25 corresponding to the LED 45 in the light on state in the randomly generated sequence within the allocated time. To increase the difficulty, the time allotted to locate each button mechanism 25 will decrease with each correct selection. The processor 80 sends an audio signal to the speaker 95 indicating a correct selection and further sends an audio signal to the speaker 95 when there is an incorrect selection signaling the end of the game play and indicating a user's score. At the conclusion of game play, the user has the option to start a new game by pressing the corresponding button mechanism 25 or selecting one of the other games included in the interactive gaming device 10.

Sixth Example of Game Play

In a sixth example of game play, the object is to follow a randomly generated color pattern according to audio signals. To start play, the processor 80 sends an audio signal to the speaker 95 as a voice command and the user presses the corresponding button mechanism 25. For example, the speaker 95 will emit the word "Red" as a voice command. If the user presses the button mechanism 25 on the red side, the processor 80 sends an audio signal to the speaker 95 to continue the sequence, such that the voice will then say "Red, Yellow." The user must select and press the correct button mechanisms 25 according to the color sequence to repeat the pattern. With each correct selection, the processor 80 will direct the sequence to repeat and add one or more colors to the sequence for the subsequent rounds. The processor 80 may be programmed to increase in difficulty as a user advances in game play. For example, when a user correctly presses a five button sequence, the processor 80 resets the round and randomly generates a color sequence requiring the user to follow a six button sequence. An incorrect selection will prompt the processor 80 to send an audio signal indicating the end of game play. After the conclusion of game play, the user has the option to start a new game or select one of the other games included in the interactive gaming device 10 by pressing the corresponding button mechanisms 25.

There is a virtually unlimited amount of play patterns that can be included in the gaming content. The examples above are meant to be but a few of the many and are not meant to limit the invention in any manner.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. An interactive gaming device comprising:

a polyhedron housing having an internal mount plate and having a plurality of substantially planar faces, each face includes a plurality of tiles and at least one opening;

at least one recessed chamber secured to the internal mount plate and separately positioned about each opening such that a top edge defined by the recessed chamber is positioned in each opening and substantially flush with a surface of the tiles adjacent said opening thereby maintaining a substantially planer face;

each recessed chamber includes a bottom base, a light source, and a switch, the light source and the switch being positioned about a said bottom base, the recessed chamber being sized to accommodate a portion of a user's finger and having a predetermined depth such that the line of sight of the light source is impaired when viewed at an angle; and a processor mounted to the internal mount plate and having pre-programmed gaming content stored on a memory, the processor in communication with each light source and each switch, the pre-programmed gaming content when activated by the processor randomly activates or deactivates light sources prompting a user to respond by maneuvering the polyhedron housing such that the line of sight of a light source changes whereby the user is able to respond to the pre-programmed gaming content by pressing one or more switches.

2. The interactive gaming device of claim 1 further comprising a light driver in communication with the processor and one or more of the light sources to control a level of illumination of said light sources.

3. The interactive gaming device of claim 1, further comprising a speaker fixed to the mount plate and in communication with said processor and the pre-programmed gaming content when activated causes the speaker to emit a predefined sound indicative of the activation of a specific light source.

4. The interactive gaming device of claim 3, wherein the opening in each face is positioned in a center region of the face and the opening is surrounded on all sides of the opening by tiles.

5. The interactive gaming device of claim 3, wherein said gaming content utilizes the light sources and/or speaker to prompt a user to maneuver the polyhedron housing in order to actively press one or more switches.

6. The interactive gaming device of claim 3, wherein each face is a different color and each bottom base of the recessed chamber in a corresponding face includes a lens shaded to match the color of the corresponding face.

7. The interactive gaming device of claim 1, wherein said processor includes a means to randomly activate the lights to prompt the user to press a switch.

8. An interactive gaming device comprising:

a polyhedron housing having an internal mount plate and having a plurality of substantially planar faces, each face includes a plurality of tiles and at least one opening;

a recessed chamber secured to the internal mount plate and separately positioned about each opening such that a top edge defined by the recessed chamber is positioned in the openings and substantially flush with a surface of the tiles adjacent said opening thereby maintaining a substantially planer face;

each recessed chamber includes a light source, and a switch; and a processor mounted to the internal mount plate and having pre-programmed gaming content stored on a memory, the processor is in communication with each light source and each switch, the pre-programmed gaming content when activated by the processor randomly activates or deactivates light sources promoting a user to respond by maneuvering the polyhedron housing whereby the user is able to respond to the pre-programmed gaming content by pressing one or more switches.

9. The interactive gaming device of claim 8 further comprising a light driver in communication with the processor and one or more of the light sources to control a level of illumination of said light sources, wherein the pre-programmed gaming content includes a game that first directs the processor to set the level of illumination of a light source to a starting level and second directs the processor to decrease the level of illumination of a light source such that a user responding to the decrease in the level of illumination of said light source will trigger the switch corresponding to the decreased illuminated light source to signal the processor and cause the pre-programmed gaming content to direct the processor to increase the level of illumination of said light source back to said starting level, wherein if the user does not trigger the switch corresponding to the decreased illuminated light source prior to the light source reaching a pre-determined lower level, the pre-programmed gaming content directs the processor to end the game.

10. The interactive gaming device of claim 8, wherein each switch is positioned about a bottom base defined by the recessed chamber, the recessed chamber being sized to accommodate a portion of a user's finger and having a pre-determined depth such that the line of sight of the light source is impaired when viewed at an angle.

11. The interactive gaming device of claim 8, wherein each face is a different color and each bottom base of the recessed chamber in a corresponding face includes a lens shaded to match the color of the corresponding face.

12. The interactive gaming device of claim 11, wherein the opening in each face is positioned in a center region of the face and the opening is surrounded on all sides of the opening by tiles.

13. The interactive gaming device of claim 12, further comprising a speaker fixed to the mount plate and in communication with said processor and the pre-programmed gaming content when activated causes the speaker to emit a pre-defined sound indicative of the activation of a specific light source.

14. An interactive gaming device comprising:

a housing including a plurality of openings a plurality of recessed chambers positioned within the openings, each recessed chamber having a base and sized to receive a portion of a user's finger;

a plurality of switches separately positioned at the base of each recessed chamber;

each of said switches includes a light and a trigger mechanism in electrical communication with a processor wherein said electrical communication enables the transfer of power and information between said processor and said switches to active the light; and a memory including programming to create gaming content, wherein said processor accesses said memory and creates said gaming content to activate or deactivate the lights, causing a user to respond by maneuvering the housing to identify the activated or deactivated lights and press the lights to respond to the created gaming content.

15. The interactive gaming device of claim 14, wherein the recessed chamber has a depth such that the visible line of sight of the lights is limited causing the user to maneuver the housing to attain a line of sight of the lights such that the user can properly identify the activated or deactivated lights.

16. The interactive gaming device of claim 14, wherein each face is a different color and each bottom base of the recessed chamber in a corresponding face includes a lens shaded to match the color of the corresponding face.

17. The interactive gaming device of claim 16, wherein said processor compares responses to said gaming content to determine an accuracy level of said responses.

18. The interactive gaming device of claim 17, wherein said processor generates a plurality of distinct and visually perceptible light indications in accordance with said determination of the response accuracy level.

19. The interactive gaming device of claim 14 further comprising a light driver in communication with the processor and one or more of the light sources to control a level of illumination of said light sources.

* * * * *